US006856295B2

(12) United States Patent
Desargant et al.

(10) Patent No.: US 6,856,295 B2
(45) **Date of Patent: *Feb. 15, 2005**

(54) ATTENUATION APPARATUS FOR MINIMIZING REFLECTIONS OF ELECTROMAGNETIC ENERGY FROM AN ANTENNA DISPOSED WITHIN A RADOME

(75) Inventors: Glenn J. Desargant, Fullerton, CA (US); Albert Louis Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/390,288

(22) Filed: Mar. 17, 2003

(65) Prior Publication Data

US 2004/0233116 A1 Nov. 25, 2004

Related U.S. Application Data

(63) Continuation-in-part of application No. 09/952,752, filed on Sep. 14, 2001, now Pat. No. 6,570,540.

(51) Int. Cl.[7] ..... H01Q 1/28
(52) U.S. Cl. ..... 343/705; 343/708
(58) Field of Search ..... 343/705, 708, 343/872; H01Q 1/28

(56) References Cited

U.S. PATENT DOCUMENTS

| | | | | |
|---|---|---|---|---|
| 4,581,615 A | | 4/1986 | Levy | |
| 4,677,443 A | | 6/1987 | Koetje et al. | |
| 5,173,699 A | | 12/1992 | Barr et al. | |
| 5,231,413 A | * | 7/1993 | Dubois | 343/833 |
| H1219 H | * | 8/1993 | Miller | 343/708 |
| 5,959,590 A | * | 9/1999 | Sanford et al. | 343/781 CA |
| 6,570,540 B2 | * | 5/2003 | Desargant et al. | 343/705 |

FOREIGN PATENT DOCUMENTS

| | | |
|---|---|---|
| DE | 42 23 138 A1 | 6/1993 |
| EP | 0 017 589 A1 | 10/1980 |
| EP | 0 174 579 A2 | 3/1986 |
| GB | 2 120 858 A | 12/1983 |

OTHER PUBLICATIONS

International Search Report dated Dec. 30, 2002, Int'l. App. No. PCT/US02/28116.

* cited by examiner

*Primary Examiner*—Hoanganh Le
(74) *Attorney, Agent, or Firm*—Harness Dickey & Pierce P.L.C.

(57) ABSTRACT

An attenuation device for use under a radome disposed on a mobile platform such as an aircraft for reflecting a portion of the electromagnetic energy radiated by an antenna disposed under the radome such that the reflected portion of energy impinges the radome at an angle normal thereto, thereby reducing or eliminating further reflections of the reflected portion of energy within the radome toward the mobile platform. In one embodiment the radome includes a base covered with a radar absorbing material (RAM). In another embodiment the radome includes a curved base adapted to match the mobile platform surface curvature on which the attenuation apparatus is mounted. In a further embodiment, RAM is disposed on an exterior surface of the mobile platform under the radome. In still another embodiment, the base is formed of an attenuating transverse magnetic TM wave corrugated plate.

19 Claims, 6 Drawing Sheets

FIG 1
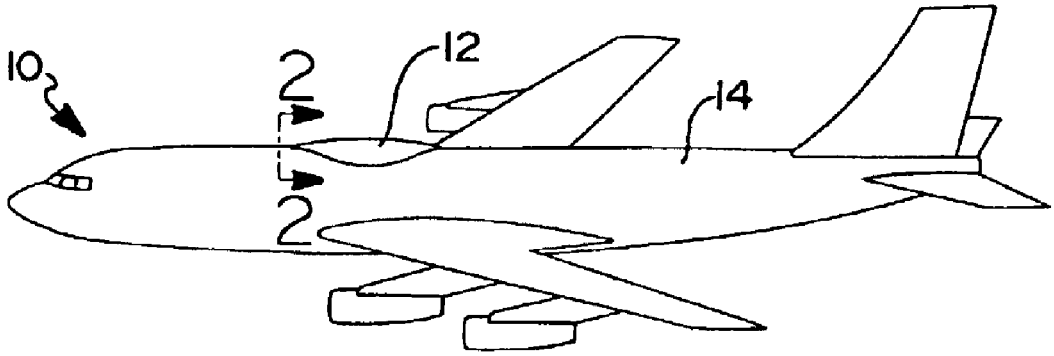
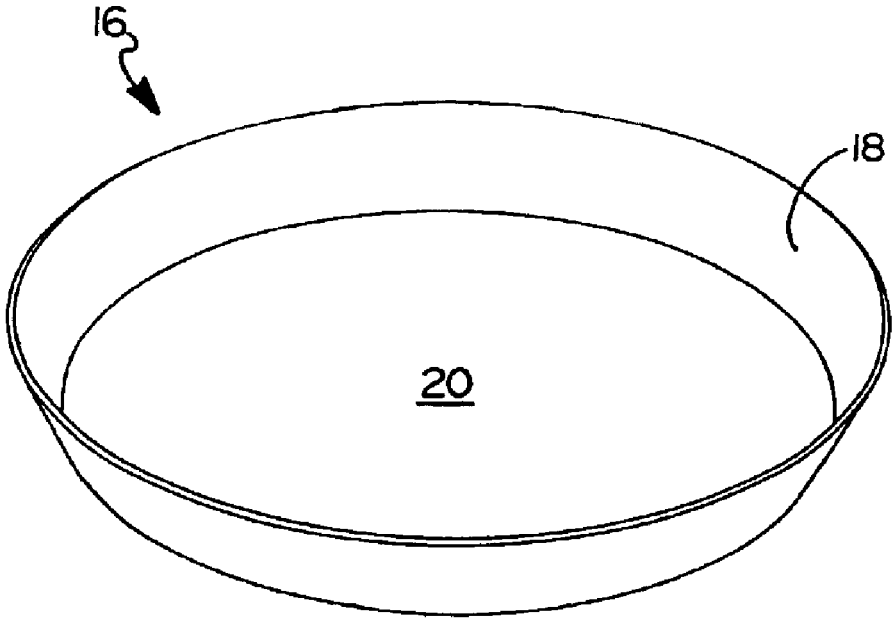
FIG 3

ATTENUATION APPARATUS FOR MINIMIZING REFLECTIONS OF ELECTROMAGNETIC ENERGY FROM AN ANTENNA DISPOSED WITHIN A RADOME

CROSS-REFERENCE TO RELATED APPLICATIONS

This application is a continuation-in-part of U.S. patent application Ser. No. 09/952,752 filed on Sep. 14, 2001, now U.S. Pat. No. 6,570,540, the disclosure of which is incorporated herein.

FIELD OF THE INVENTION

This invention relates to antenna assemblies, and more particularly to an attenuation apparatus and/or a radar absorbing material for use with an antenna disposed within a radome on a mobile platform such as an aircraft for reducing reflections of electromagnetic energy within the radome.

BACKGROUND OF THE INVENTION

Transmit and receive antennas are now being used on the exterior surfaces of commercial aircraft to provide broadband interconnectivity with ground based stations via one or more satellite-based transponders. Such antennas are often electronically scanned phased array antennas; mechanically augmented phased array antennas; mechanically scanned reflector antennas summarized herein as antennas from the group including single reflector antennas, reflector arrays or planar arrays configured in a planar or elliptical shape; or other forms of antennas which are disposed on an exterior surface of the fuselage of the aircraft. Except for non-mechanically scanned phased array antennas, the antenna is typically mounted within a radome and radiates its beam through the radome when in a transmit mode of operation. Non-mechanically scanned phased array antennas normally do not require a radome due to their low aerodynamic cross section.

An undesirable consequence of mounting the antenna within an aerodynamically shaped radome is the creation of reflections of electromagnetic energy caused by the radiated electromagnetic energy impinging the radome at angles other than normal to the interior surface of the radome. However, when electromagnetic energy impinges the radome at an angle normal to the surface of the radome, the great majority of the energy passes through the radome. A mechanically scanned antenna system is required to point the transmit-receive antenna beam over 360 degrees in azimuth and nearly 90 degrees in elevation during aircraft to satellite communications operation. Aerodynamic radomes are frequently designed with multilayered dielectric walls to minimize the loss of transmit and receive electromagnetic energy passing through the radome. The radome design performs effectively for antenna radiated energy angles within plus or minus 50 degrees from normal incidence to the interior surface of the radome. However, as the angles of incidence increase from 70 to 90 degrees, reflection losses increase significantly. Interior radome surface reflections are highest near the radome wall transition from vertical to horizontal, when the antenna system is pointed at elevation angles from 0 to 30 degrees, and in particular, aft towards the tail of the aircraft. This is due to the common flattened teardrop shape used for the aerodynamic radome, which tapers both in width and in height towards the aft direction. In this region, the electromagnetic energy emanating from the antenna impinges on the wall of the radome at incident angles ranging from 80 to 90 degrees. Reflected energy is highest at these large angles of incidence.

The problem with reflected energy is also acute when the main beam from the mechanically scanned antenna is scanned along an axis which is close to parallel to the exterior of the fuselage of the aircraft. At this scan angle, the electromagnetic energy impinges an interior surface of the radome which is tapering toward the fuselage. Electromagnetic energy impinges the interior surface at an angle which is not normal thereto, thus causing a significant degree of energy to be reflected by the interior surface of the radome back toward the fuselage.

Reflected energy is highly undesirable as this energy can be directed into the skin of the aircraft, wherein the skin can act as an antenna to further radiate the energy towards other RF receivers or transceivers in the vicinity of the aircraft, and particularly transceivers located on the ground below the aircraft. It is also undesirable for a communications system to have its high level radiated transmit power reflected back into the antenna aperture and into the low noise receiver. Since the radome must have a highly aerodynamic shape, it becomes impossible to avoid the problem of reflections within the radome because at such angles as described above, the main beam radiated by the antenna will always be impinging the walls of the radome at angles that are not normal to the interior surface of the radome.

Accordingly, it would be highly desirable to provide some form of attenuation apparatus within the radome which at least partially circumscribes the antenna to reflect and/or absorb a portion of the radiated electromagnetic energy from the antenna toward the interior surface of the radome such that the reflected electromagnetic energy is absorbed or impinges the interior surface of the radome at an angle normal thereto, thus minimizing the reflections that occur within the radome when the antenna is scanned.

It would also be highly desirable to provide such an attenuation apparatus as described above that does not interfere with operation of the antenna, whether the antenna is a mechanically scanned phased array antenna, a mechanically scanned antenna including reflectors, reflector arrays or planar arrays, or other form of reflector antenna, and further which does not require modifications to the shape of the radome or necessitate non-aerodynamic modifications to the contour of the radome.

It would also be highly desirable to provide additional attenuation of reflected energy within a radome perimeter where an attenuation apparatus cannot totally shield the fuselage surface under the radome.

SUMMARY OF THE INVENTION

The present invention is directed to an attenuation apparatus for use within a radome mounted on an exterior surface of a mobile platform. In the embodiments illustrated and described herein, the radome is particularly well adapted to be secured to an exterior surface of a commercial aircraft. However, it will be appreciated that the attenuation apparatus could be used on any form of mobile platform where an aerodynamic radome is required.

In one preferred form, the attenuation apparatus comprises a frustoconical member which is adapted to be mounted to the exterior surface of the mobile platform on which the radome is mounted. The attenuation apparatus, in one preferred form, is elliptically shaped and completely circumscribes the antenna. In a preferred embodiment the attenuation apparatus also includes a base portion which forms a planar panel adapted to be disposed against or adjacent to the outer surface of the mobile platform on which the radome is mounted. The base portion can support the antenna directly thereon or can be used to support an intermediate component which itself is supporting the antenna. The attenuation apparatus, as well as the base, is preferably manufactured from a thin metallic plate and includes a TM corrugated surface or a layer of radar absorbing material (RAM) on an upper surface thereof. The attenuation apparatus is formed such that it diverges from the outer surface of the mobile platform. The angle of divergence is dependent on the precise contour of the fuselage and radome.

In one preferred embodiment, at least one independent attenuation plate is disposed on an exterior surface of the mobile platform outwardly of the reflector antenna to further reflect or absorb reflected electromagnetic energy that would otherwise be directed by the interior surface of the radome back into the metallized skin of the mobile platform.

In another preferred embodiment, the attenuation apparatus includes a horizontal plate and an outer, angled wall. The horizontal plate has a corrugated surface and the angled wall is covered with radar absorbing material, RAM. The corrugated surface attenuates incident energy with a plurality of concentric channels that serve to capture and ground the TM electric field as it propagates away from the antenna aperture.

In yet another preferred embodiment, the antenna assembly is mounted to the fuselage and a layer of RAM is disposed on the fuselage adjacent to the antenna assembly and within the perimeter of the radome. A layer of RAM is also disposed over the structure used to mount the radome to the mobile platform.

The angle of the attenuation apparatus wall is further selected based on the contour of the radome, and further such that the attenuation apparatus wall will intercept a portion of the main beam radiated from the antenna, when the main beam is scanned, such that the portion of the radiated electromagnetic energy is reflected by the attenuation apparatus wall towards the radome and impinges the radome at an angle normal to the interior surface of the radome. In this manner the great majority of the reflected electromagnetic energy from the attenuation apparatus wall passes through the radome without the radome causing any further reflections thereof toward the mobile platform.

The attenuation apparatus of the present invention can thus be used with a wide variety of antennas and does not require modifications to the aerodynamic shape of the radome, which is extremely important in maintaining a smooth aerodynamic profile for the radome.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a side view of a commercial aircraft showing a radome mounted on an exterior surface of a fuselage of the aircraft;

FIG. 3 is a perspective view of the attenuation apparatus without the antenna of FIG. 2 being mounted thereon;

DETAILED DESCRIPTION OF THE PREFERRED EMBODIMENTS

The following description of the preferred embodiments is merely exemplary in nature and is in no way intended to limit the invention, its application, or uses.

Referring to FIG. 1, there is shown an aircraft 10 upon which a radome 12 is mounted. It will be appreciated immediately, however, that while an aircraft has been illustrated as the mobile platform with which the present invention is to be used, that the present invention can be adapted for use with virtually any other form of mobile platform such as a bus, train, ship or any other form of vehicle or structure that requires the use of an aerodynamic radome.

The radome 12 typically has an overall length which is about seven to ten times that of its height to provide a highly aerodynamic profile. The highly aerodynamic profile is extremely important with commercial aircraft to minimize wind drag and therefore minimize the effect of the radome 12 on the performance of the aircraft and its fuel economy. The radome 12 may be mounted directly on an outer surface of the fuselage 14 of the aircraft 10 or to some intermediate component.

Figure 2:
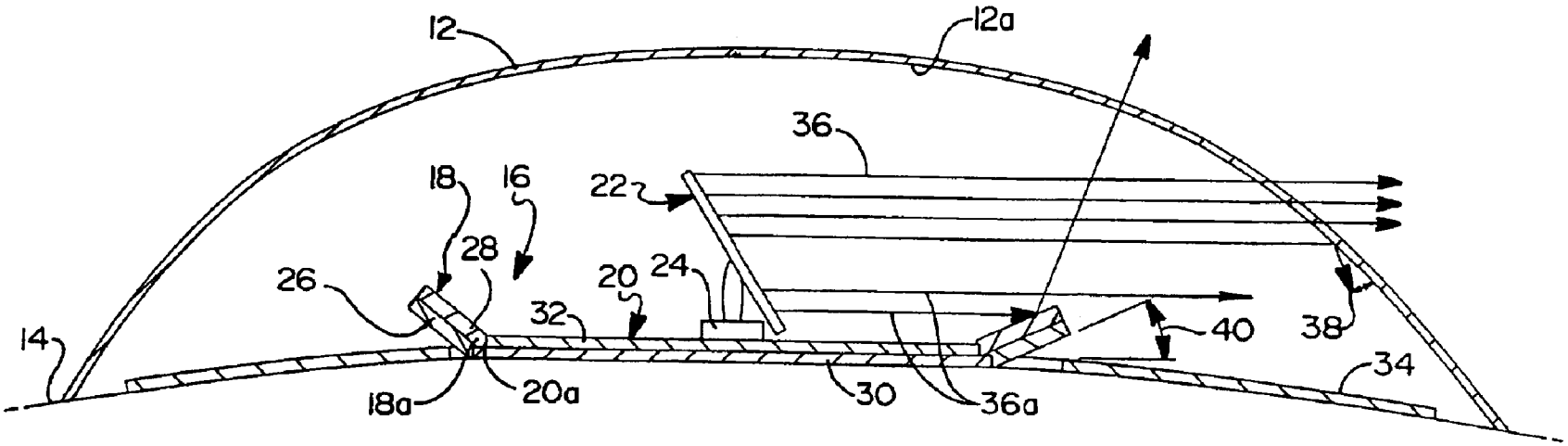
FIG. 2 is a simplified cross sectional view taken in accordance with section line 2—2 in FIG. 1 illustrating the attenuation apparatus of the present invention disposed so as to circumscribe a mechanically scanned phased array antenna supported on the fuselage within the radome.

Referring to FIG. 2, within the radome 12 is disposed an attenuation apparatus 16 in accordance with a preferred embodiment of the present invention. The shaped attenuation apparatus 16 includes a frustoconical, angled wall 18 and a base portion 20. Disposed on the base portion 20 is an antenna 22. Antenna 22 may form virtually any type of mechanically scanned antenna such as a mechanically augmented phased array antenna, a reflector antenna, or an array of elliptical or planar antennas, etc. For purposes of illustration, antenna 22 is illustrated as having a mechanism 24 for rotating and supporting the antenna above the base portion of the attenuation apparatus 16. Thus, in this example, the antenna 22 takes the form of a mechanically augmented phased array antenna.

The angled wall 18, of the shaped, attenuation apparatus, is preferably formed from a single, relatively thin plate of metal 26 over which is disposed a layer of radar absorbing material (RAM) 28. Similarly, the base portion 20 is formed from a thin plate of metal 30 over which a layer of RAM 32 is disposed. An outer periphery 20*a* of the base portion 20 could be secured to an inner periphery 18*a* of the frustoconical wall 18 or could simply be secured to the fuselage 14 adjacent the inner periphery 18*a*. Furthermore, the RAM layer 28 could be comprised of a slightly different material than RAM layer 32. The metallic portion 26 is preferably comprised of a thin sheet of metal, preferably aluminum, and may have a thickness which is sufficient to ensure the necessary structural rigidity thereof. It is anticipated that a thickness of 0.050 to 0.250 inch (1.27 to 6.35 mm, respectively) will be sufficient for most applications to provide the necessary structural rigidity. The RAM layer 28 may also vary in thickness but in one preferred form comprises a thickness of about 0.030 inches (0.76 mm).

While the attenuation apparatus 16 has been illustrated as including the base portion 20, it will be appreciated that the frustoconical wall 18 could be used without the base portion 20 to achieve the necessary redirection of electromagnetic energy, as will be described momentarily. Providing the base portion 20, however, helps to absorb any reflections of electromagnetic energy caused by the radome which would otherwise be directed back toward the fuselage 14 in the vicinity of the antenna 22. If the base portion 20 is included, then a preferred thickness of the metal portion 30 is also preferably around 0.050 to 0.250 inch (1.27 to 6.35 mm, respectively). The RAM layer 32 may vary in thickness based upon the operating frequency of the communications system.

FIG. 2 also illustrates the use of a RAM panel 34 in the form of a doughnut shaped ring which is secured directly to the fuselage 14 outwardly of the outer periphery 20*a* of the base portion 20 of attenuation apparatus 16. The RAM panel may be comprised of any suitable RAM material and further serves to absorb electromagnetic energy reflected by an interior surface of the radome 12 which is reflected back toward the fuselage 14 of the aircraft 10.

In operation, when the main beam of the antenna 22, indicated by horizontal lines 36 in FIG. 2, is scanned at an angle off of the boresight of the antenna, this causes the main beam to extend along an axis which may be closely parallel, or even parallel, to the fuselage 14 covered by the radome 12. In this instance, the main beam 36 will not be impinging the interior surface 12*a* at an angle normal to the interior surface. When this occurs, a portion of the electromagnetic energy of the main beam 36 will be reflected by the interior surface 12*a* at an angle 38 in FIG. 2 which is identical to the incident angle between the main beam and the line extending tangent to the radome 12 at the point the main beam impinges the radome. A lower portion of the beam 36, represented by lines 36*a*, is especially troubling because this electromagnetic energy will be reflected toward the fuselage 14 and cannot be absorbed by the attenuation apparatus panel 34 without the use of an extremely large diameter attenuation apparatus panel which essentially covers most of the area of the fuselage under the radome 12. Thus, it becomes highly desirable to be able to reflect a portion (i.e., portion 36*a*) of the electromagnetic energy radiated by the lower portion of the antenna 22 to prevent this portion of energy from being reflected by the radome 12 back toward the fuselage 14.

The frustoconical wall 18 accomplishes the above objective by presenting a surface in the path of the portion 36*a* of main beam 36. The frustoconical angled wall 18 is also shown in FIG. 3. The collimated wave front near the aperture can be represented as a bundle of parallel rays. As the antenna scans toward the horizon, at elevation angles of 0 to 10 degrees, the parallel rays will diverge as they radiate away from the antenna aperture. The lower rays will impinge on any metallic surface including the fuselage. In operation, the frustoconical wall 18 of attenuation apparatus 16 serves to reflect a portion of the electromagnetic energy radiated from the lower portion of the antenna 22 upwardly toward the interior surface 12*a* of the radome 12 such that this reflected energy impinges the interior surface of the radome at an angle normal thereto. In this manner, the reflected electromagnetic energy (represented by lines 36*a*) is able to pass directly through the radome 12 without the radome causing any further significant reflections of this energy. By directing the reflected electromagnetic energy upwardly and away from the fuselage 14, interference with other RF transceivers or receivers on the ground at locations in the vicinity of the aircraft 10 will not be affected by reflected electromagnetic energy, which could otherwise cause interference with such receivers or transceivers. The use of attenuation apparatus panel 34 further serves to absorb reflected portions of the electromagnetic energy radiated from the antenna 22 which would impinge the fuselage 14 at areas relatively close to the attenuation apparatus 16 that would reflect the high powered transmit energy back into the antenna aperture and into the low noise receiver of its own communications system.

It will also be appreciated that while the attenuation apparatus 16 has been illustrated as having a generally uniform, circular shape, as shown in FIG. 3, that the shape of the attenuation apparatus 16 could be non-circular, and portions thereof could have a greater or lesser angle of inclination than other areas of the frustoconical wall portion 18. The overall shape of the attenuation apparatus, as well as its angle of inclination 40 relative to the base portion 20 in FIG. 3, is dictated by the contour of the radome 12 and the curvature of the fuselage 14 surface. It is anticipated that in most applications an angle of inclination 40 of between about 5°–45° will be preferred.

Figure 4:
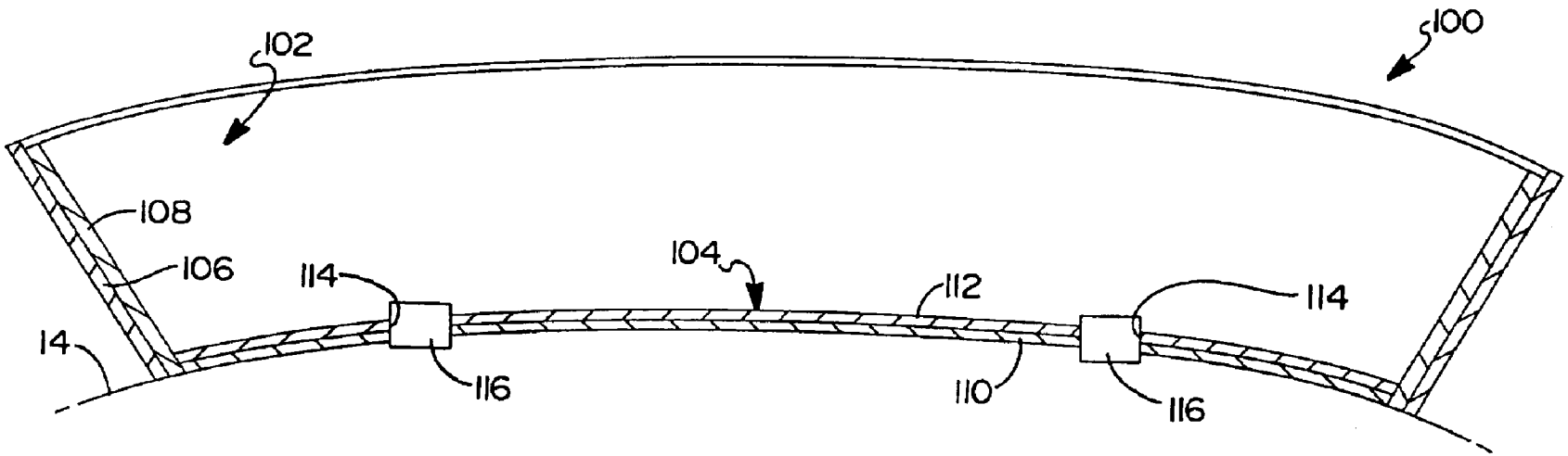
FIG. 4 is a simplified side cross sectional view of an attenuation apparatus in accordance with an alternative preferred embodiment of the present invention incorporating a base portion having a curvature adapted to match that of the fuselage of the aircraft to which it is to be mounted.

Referring now to FIG. 4, a simplified cross sectional view of an attenuation apparatus 100 in accordance with an alternative preferred embodiment of the present invention is shown. Attenuation apparatus 100 is similar to attenuation apparatus 16 in that it includes a frustoconical wall portion 102 and a base 104. Frustoconical wall portion 102 similarly includes a metal wall 106 and a RAM layer 108 disposed thereon. Likewise, base portion 104 includes a metal wall 110 and a RAM layer 112 disposed thereon. The principal difference between attenuation apparatus 16 and attenuation apparatus 100 is that the base 104 of attenuation apparatus 100 has a slight curvature adapted to match the curvature of the fuselage 14 of the aircraft. The base 104 further includes openings 114 for enabling suitable fastening elements, represented in highly simplified form by blocks 116, to be used to secure the base 104 directly to the fuselage 14.

The attenuation assemblies 16 and 100 of the present invention thus form a means by which a portion of the electromagnetic energy radiated from an antenna mounted under a radome can be reflected at a precise angle so as to impinge the interior surface of the radome at an angle normal thereto, thus substantially reducing or eliminating further reflections of the energy back toward the mobile platform on which the radome is mounted. The preferred embodiments of the attenuation apparatus described herein further do not require altering the contour of the radome nor do they require enlarging the cross sectional profile of the radome.

Figure 5:
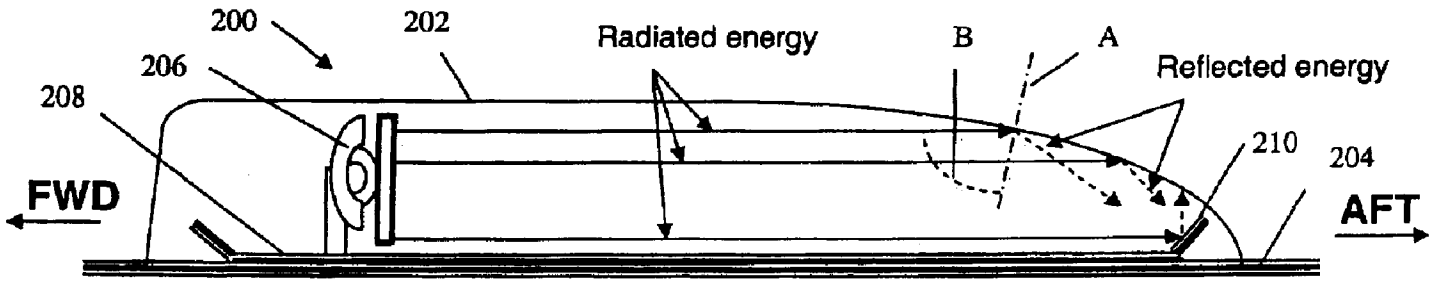
FIG. 5 is a simplified side cross sectional view of a radome assembly in accordance with another alternative preferred embodiment of the present invention incorporating a mechanically scanned antenna, and a base portion having a RAM covered surface and RAM covered, angled walls.
Figure 6:
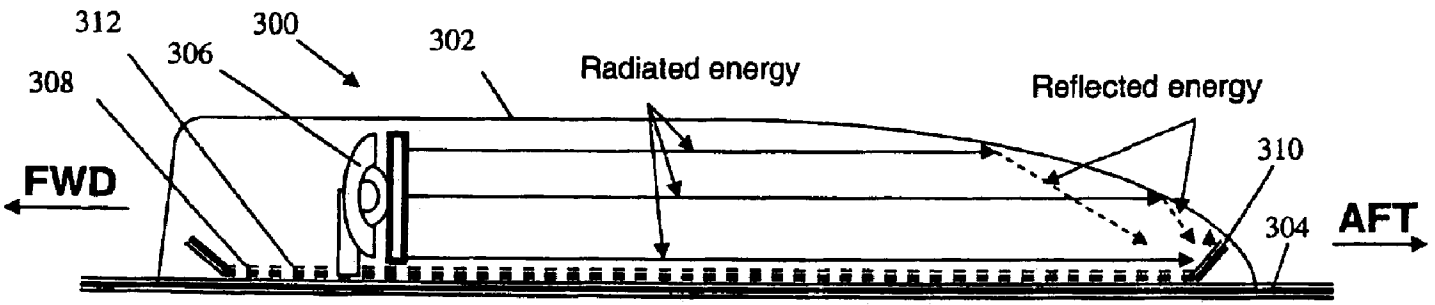
FIG. 6 is a simplified side cross sectional view of a radome assembly in accordance with yet another alternative preferred embodiment of the present invention incorporating a mechanically scanned antenna, and a shield plate having a corrugated surface and RAM covered, angled walls.
Figure 7:
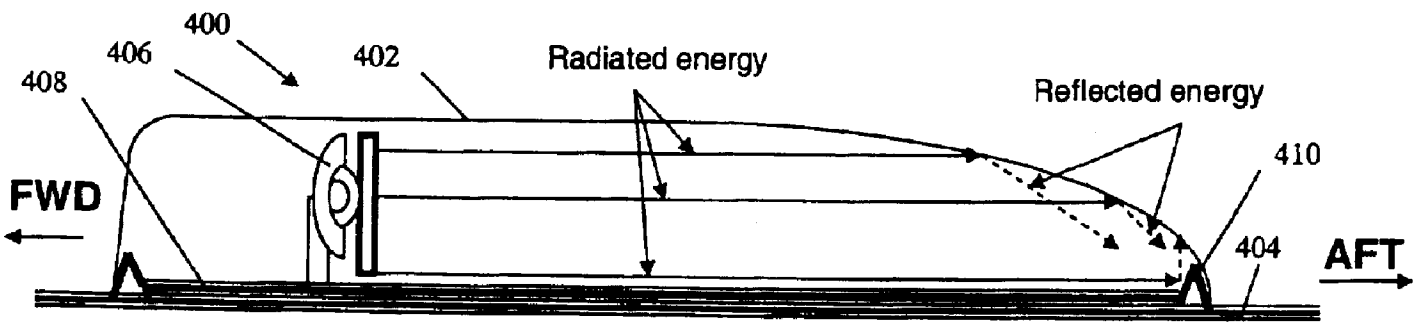
FIG. 7 is a simplified side cross sectional view of a radome assembly in accordance with still another alternative preferred embodiment of the present invention incorporating a mechanically scanned antenna, and RAM covering over a metallic fuselage skin and an inner surface of a radome-to-fuselage angled wall attachment.

Referring generally to FIGS. 5–7, an antenna assembly (206, 306 or 406, respectively) is incorporated into a radome assembly (200, 300 or 400, respectively). Each of the antenna assemblies preferably includes at least one mechanically scanned antenna. Each antenna assembly is directly supported by the fuselage 404 (in FIG. 7) or by a plate 208 or 308, respectively, (in FIGS. 5 and 6) which is subsequently attached to the fuselage. Substantially all of the energy radiated from the antenna assembly which impinges the radome at an angle of approximately 50 degrees or less from an axis normal to the radome is radiated through the radome. A lesser amount of the energy radiated from the antenna assembly which impinges the radome at an angle between 50 degrees and 70 degrees from an axis normal to the radome is radiated through the radome. A portion of the radiated energy is reflected from the radome at 50 to 70 degrees, with a smaller portion reflected from 10 to 50 degrees.

Energy radiated from the antenna assembly during "near horizon" aiming strikes the radome at a grazing angle "B" (shown in FIG. 5) and is predominantly reflected from the radome toward the fuselage. For "near horizon" aiming, the antenna assembly radiates energy relative to an axis disposed parallel to the fuselage varying between approximately zero (0) degrees to approximately thirty (30) degrees from the parallel axis. The grazing angle "B" ranges from approximately seventy (70) degrees to approximately ninety (90) degrees from an axis positioned normal to the interior radome surface. The reflected radiation is partially reflected from an angled wall. The angled wall is either disposed on the plate (also supporting the attenuation apparatus) or directly attached to the fuselage. The angled wall is angled with respect to the fuselage to reflect incident energy back toward the radome approximately normal to the radome surface to increase the total amount of radiated energy passing through the radome. The angled walls (210, 310 and 410, respectively) of FIGS. 5–7 are similar to the frustoconical wall 18 (shown and described in reference to FIG. 3), having upper and lower edges, the lower edge. connectably disposed to either the fuselage or a plate, and being disposed at similar angles to the fuselage.

Referring specifically to FIG. 5, a radome assembly 200 includes in part a radome 202 attached to a fuselage 204. A mechanically scanned antenna assembly 206 is mounted to a RAM coated plate 208 having a surrounding angled wall 210. Radiated energy from the antenna assembly 206 is partially reflected from the radome 202 to the angled wall 210 where the reflected, radiated energy is reflected by the angled wall 210 or absorbed by the RAM coating thereon. FIG. 5 shows an exemplary "near horizon" radiated energy path approximately parallel to the fuselage 204. As previously noted, because the radiated energy path is incident to the radome at the grazing angle "B", (measured from an axis "A" perpendicularly disposed through the radome), at least partial reflection of the radiated energy from the inner wall of the radome 202 occurs.

As best seen in FIG. 6, a radome assembly 300 is similar to the radome assembly 200. The radome assembly 300 includes a radome 302 disposed on a fuselage 304. A mechanically scanned antenna assembly 306 is mounted to a shield plate 308. The shield plate 308 includes at least a partially corrugated plate face 312, and includes a surrounding angled wall 310 having a RAM layer thereon. The radiated energy path shown in FIG. 6 is similar to that shown in FIG. 5. Radiated energy is partially reflected from the radome 302 to the plate face 312, where it is substantially attenuated and partially reflected, or to the angled wall 310 where it is partially reflected and substantially absorbed. In separate areas from the corrugation, the plate face 312 can also have a partial RAM covering (not shown) for energy absorption.

Referring now to FIG. 7, a radome assembly 400 includes a radome 402 supported from a fuselage 404. A mechanically scanned antenna assembly 406 is supported from the fuselage 404. The fuselage 404 is covered with a RAM layer 408 beneath the radome 402. A support collar 410 peripherally connects the radome 402 to the fuselage 404 within a perimeter of the radome 402. For applications where an angled wall of an attenuation apparatus cannot be located within the perimeter of the radome 402, the RAM layer 408 is extended to cover the radome support collar 410 and as much of the non-antenna surfaces exposed under the radome as possible, including any fasteners (not shown) or antenna support structure. The radiated energy path from the reflector antenna assembly 406 shown in FIG. 7 is similar to that shown in FIG. 5. Radiated energy is partially reflected from the radome 402 toward both the support collar 410 and the fuselage 404, both having the RAM layer 408. The radiated energy is substantially absorbed by the RAM layer 408 or partially reflected by the support collar 410.

Figure 8:
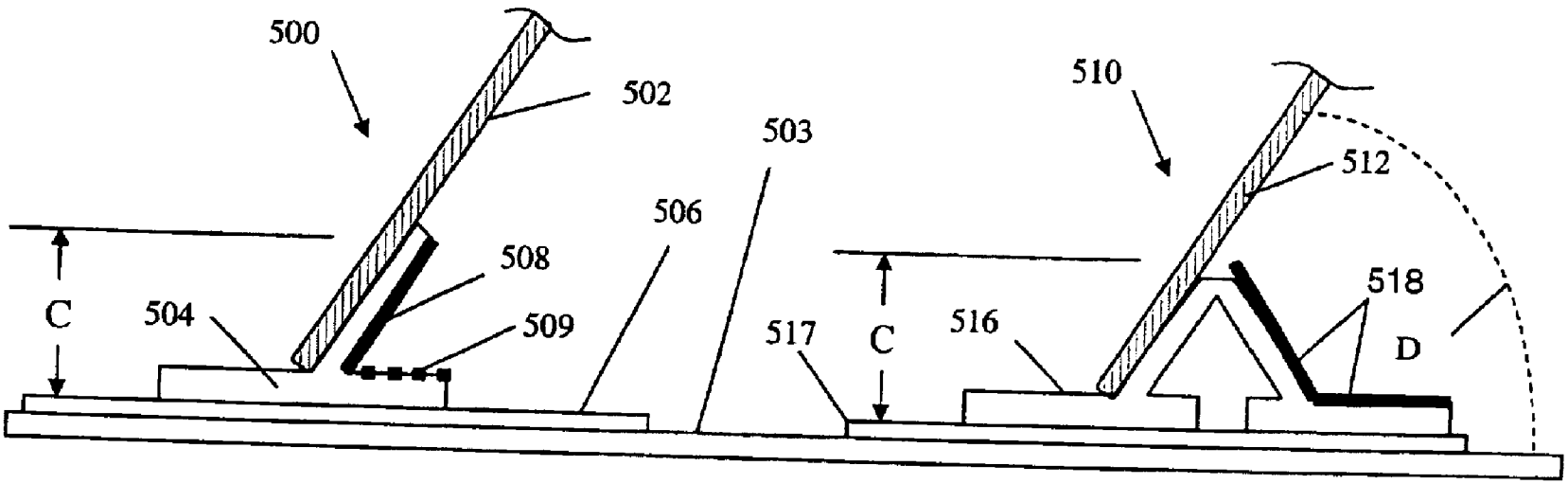
FIG. 8 is a partial cross sectional view showing radar reflecting material, RAM, applied to two common radome support collar designs in accordance with still another preferred embodiment of the present invention.

Referring to FIG. 8, two support collar designs 500 and 510 are shown. The support collars 500 and 510 connect a radome 502 and 512, respectively, to a fuselage 503. The support collar 500 includes a support collar body 504 supporting a portion of the radome 502, which is externally fastened thereto. The support collar body 504 is fastened through a doubler plate 506 to the fuselage 503. A layer of RAM 508 is disposed over the support collar body 504, within space enclosed by the radome 502, on one or more internal facing surfaces of the support collar body 504 which are disposed at an angle to the fuselage 503. A corrugated surface 509 is applied over one or more internal facing surfaces of the support collar body 504 which are disposed approximately parallel to the fuselage 503.

The support collar 510 includes a support collar body 516 supporting a portion of the radome 512, which is externally fastened thereto. The support collar body 516 is fastened through a doubler plate 517 to the fuselage 503. A layer of RAM 518 is disposed over the support collar body 504, within space enclosed by the radome 512, on one or more internal facing surfaces of the support collar body 516 which are disposed either at an angle to the fuselage 503 or approximately parallel to the fuselage 503. Similar to the support collar 500, a corrugated plate (not shown) can be applied over one or more internal facing surfaces of the support collar body 516 which are disposed approximately parallel to the fuselage 503, in place of portions of the layer of RAM 518. An exemplary support collar height "C" for both the support collar body 504 and the support collar body 516 is approximately 5.08 cm (2 inches) measured above the respective doubler plates 506 and 517.

Figure 9:
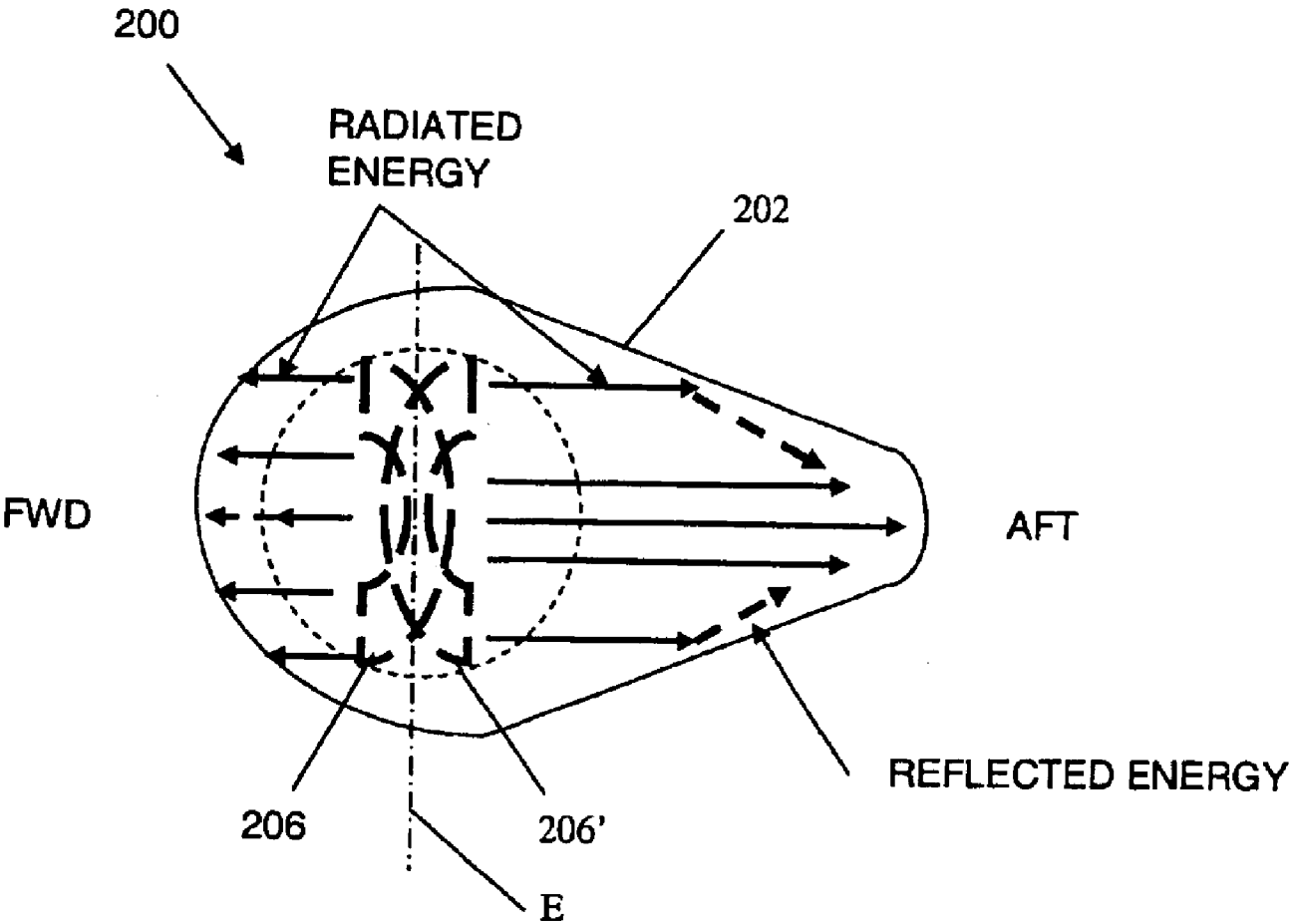
FIG. 9 is a plan view of the radome assembly of FIG. 5, showing the antenna assembly rotated to radiate in both forward and aft directions, and identifying aft radiation reflection paths off the radome.

Referring finally to FIG. 9, the radome 202 is formed in a common teardrop shape. The mechanically scanned antenna assembly 206 is shown in both a forward radiating direction and a rearward radiating direction (identified as item 206'). The mechanically scanned antenna assembly 206 is centered about an axis "E". Aft directed radiated energy is shown reflecting off the interior walls of the radome 202. A significant amount of energy is reflected by the interior walls of the radome back toward the fuselage due to the downward curving outer surfaces of the radome 202 as the radome 202 follows the curvature of the fuselage (item 14 in FIG. 2).

The RAM layer(s) 508 and 518, described herein in reference to FIG. 8, can be formed in various ways, including as a sheet, a casting or a spray coating. The angle between support collars 410, 506 and 516 and the aircraft fuselage (shown as exemplary angle "D" in FIG. 8), is fixed for each application, but can be varied during manufacture to an optimum angle which reduces reflection of electromagnetic radiation off the support collar, taking into consideration the fuselage curvature and final radome size and shape.

The shield plates 208 and 308 of FIGS. 5 and 6, respectively, can be fabricated of a single metal plate, or fabricated from a plastic or composite material (e.g., graphite-epoxy, epoxy-fiberglass, etc.) to reduce weight of the shield plate. A plastic or composite plate would then be metal plated on a top surface (i.e., the surface facing the radome). RAM material can then be disposed over the metal plating. Plastic or composite shield plate(s) can also be machined or formed to include a corrugated surface and the metal plating applied over the corrugated surface.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An apparatus adapted for use under a radome, wherein the radome is disposed on an exterior surface of a mobile platform and the radome encloses a mechanically scanned antenna, for absorbing a first portion of electromagnetic energy and reflecting a second portion of electromagnetic energy within the radome away from the exterior surface of the mobile platform, the apparatus comprising:

an angled wall at least partially circumscribing said mechanically scanned antenna and disposed adjacent to said exterior surface, said angled wall being disposed so as to diverge from said exterior surface of said mobile platform; and wherein said angled wall operates to absorb said first portion of said electromagnetic energy and reflect said second portion of said electromagnetic energy reflected from an interior surface of said radome toward said exterior surface back toward said interior surface of said radome such that said electromagnetic energy impinges said interior surface of said radome at an incidence angle generally normal to said interior surface, to enable said electromagnetic energy to pass through said radome.

2. The apparatus of claim 1, comprising a layer of radar absorption material disposed on said angled wall to further absorb said electromagnetic energy.

3. An attenuation apparatus adapted for use under a radome, wherein the radome is disposed on an exterior surface of a mobile platform and encloses a mechanically scanned antenna, for absorbing and reflecting electromagnetic radiation radiated from said antenna away from said mobile platform, said attenuation apparatus comprising:

an angled wall at least substantially circumscribing said mechanically scanned antenna and disposed adjacent said exterior surface, and extending at an angle so as to diverge from said exterior surface of said mobile platform;

said angled wall operating to reflect a portion of electromagnetic energy radiated from said mechanically scanned antenna when said antenna is radiating said energy at a predetermined scan angle which would result in a portion of said energy being reflected by said radome back toward said mobile platform; and said angled wall operating to reflect said portion of said energy toward an interior surface of said radome such that said portion of said energy impinges said radome at an angle generally normal to said interior surface of said radome, to thereby maximize the likelihood of said portion of said energy passing through said radome without being further reflected back toward said mobile platform.

4. The attenuation apparatus of claim 3, further comprising a plate disposed within said angled wall for further absorbing electromagnetic energy reflected by said radome back toward said mobile platform.

5. The attenuation apparatus of claim 3, further comprising at least one reflection absorbing panel disposed on said exterior surface inwardly of said angled wall for further absorbing electromagnetic energy reflected by said radome toward said mobile platform.

6. An attenuation apparatus adapted for use under a radome, wherein the radome is disposed on an exterior surface of a vehicle and encloses at least one antenna, for reflecting electromagnetic radiation radiated from said antenna away from said vehicle, said attenuation apparatus comprising:

a member disposed adjacent said exterior surface of said vehicle;

an angled wall circumscribing said member and extending at an angle relative to said member;

said angled wall and said angle operating to reflect a first portion of electromagnetic energy radiated from said antenna when said antenna is radiating said energy at a predetermined scan angle which would result in a first portion of said energy being reflected by said radome back toward said vehicle;

said angled wall operating to reflect said first portion of said energy toward an interior surface of said radome such that said first portion of said energy impinges said radome at an angle generally normal to said interior surface, to thereby maximize the likelihood of said first portion of said energy passing through said radome without being further reflected back toward said vehicle; and said member having a corrugated surface shape operating to substantially attenuate a second portion of said electromagnetic energy.

7. The attenuation apparatus of claim 6, wherein said member comprises a generally planar plate.

8. The attenuation apparatus of claim 6, wherein said angled wall forms a frustoconical member.

9. The attenuation apparatus of claim 7, wherein said angled wall forms a frustoconical member having a lower edge and an upper edge, said lower edge being secured adjacent an outer periphery of said plate.

10. the attenuation apparatus of claim 7, wherein said plate comprises a substrate having a radar absorbing material disposed thereon.

11. The attenuation apparatus of claim 6, wherein said angled wall comprises a substrate having a radar absorbing material disposed thereon.

12. A radiated energy absorption system mountable on a mobile platform, comprising:

a radome disposed on one of an exterior surface of said mobile platform;

a mechanically scanned antenna disposed within said radome;

a support assembly connectably joining said radome to said exterior surface, and having a first surface extending at an angle relative to a portion of said exterior surface so as to absorb a first portion of electromagnetic energy radiated from said antenna when said antenna is radiating said energy at a predetermined scan angle; and said support assembly having a second surface further operating to reflect a second portion of electromagnetic energy away from said exterior surface at an angle to thereby minimize the possibility of said second portion of electromagnetic energy being further reflected by said radome.

13. The system of claim 12, further comprising a plate disposed within said perimeter for further intercepting electromagnetic energy radiated by said antenna.

14. The system of claim 13, comprising a radar absorbing material disposed on both said plate and said support assembly.

15. The system of claim 12, wherein said angle of said support assembly is determined based at least in part on the contour of said radome.

16. The system of claim 12, further comprising:

said antenna being rotatably operable to radiate said energy within an angular range measurable from a first axis disposed approximately parallel to said exterior surface; and said predetermined scan angle defining an incident angle ranging between approximately 70 degrees to approximately 90 degrees measurable from a second axis perpendicularly disposed through said radome.

17. A method for reducing the reflection of electromagnetic radiation into a mobile platform from a mechanically scanned antenna mounted within a radome, wherein the electromagnetic radiation is at least partially reflected by the radome back toward the mobile platform on which the radome and the antenna assembly are mounted, said method comprising the steps of:

locating an angled wall adjacent to a surface of the mobile platform and peripherally circumscribing at least a portion of said antenna such that the angled wall intercepts a portion of said electromagnetic energy radiated from the antenna and reflected by the radome back toward the mobile platform;

mechanically scanning said antenna such that a portion of the electromagnetic energy reflects toward the angled wall; and using the angled wall to redirect the portion of the electromagnetic energy reflected by the randome back toward the radome at an angle relative to the radome which reduces the possibilty of the portion of the energy again being reflected by the radome back toward the mobile platform.

18. The method of claim 17, further comprising the step of using a plate disposed adjacent to an exterior surface of the mobile platform and within an interior area defined by an edge of the angled wall to absorb electromagnetic energy reflected by the randome back toward the mobile platform.

19. The method of claim 18, further comprising the step of applying a radar absorbing material on the plate to further absorb at least a portion of the electromagnetic energy reflected by the radome back toward the mobile platform.

* * * * *